US006062882A

United States Patent [19]

Hanazaki et al.

[11] Patent Number: 6,062,882

[45] Date of Patent: May 16, 2000

[54] LOW INSERTION FORCE CONNECTOR

[75] Inventors: Hisashi Hanazaki; Takao Suzuki, both of Shizuoka, Japan

[73] Assignee: Yazaki Corporation, Tokyo, Japan

[21] Appl. No.: 08/919,197

[22] Filed: Aug. 28, 1997

[30] Foreign Application Priority Data

Sep. 3, 1996 [JP] Japan ..... 8-233035
Jun. 12, 1997 [JP] Japan ..... 9-154735

[51] Int. Cl.[7] ..... H01R 13/62

[52] U.S. Cl. ..... 439/157; 439/347

[58] Field of Search ..... 439/157, 347, 439/152, 160, 310

[56] References Cited

U.S. PATENT DOCUMENTS

| | | | |
|---|---|---|---|
| 5,183,408 | 2/1993 | Hatagishi | 439/147 |
| 5,244,400 | 9/1993 | Hatagishi | 439/157 |
| 5,681,175 | 10/1997 | Busse et al. | 439/157 |

FOREIGN PATENT DOCUMENTS

| | | |
|---|---|---|
| 0 625 809 | 11/1994 | European Pat. Off. . |
| 0 669 676 | 8/1995 | European Pat. Off. . |
| 61-203581 | 9/1986 | Japan . |
| 6-54255 | 7/1994 | Japan . |

*Primary Examiner*—Paul Bradley
*Assistant Examiner*—Tho Dac Ta
*Attorney, Agent, or Firm*—Sughrue, Mion, Zinn, Macpeak & Seas, PLLC

[57] ABSTRACT

In a low insertion force connector, fitting members 30 and 40 are constituted respectively by a first cam member 30 and a second cam member 40 opposed to each other in a hood portion 21. In each of the first and second cam members, cam grooves 36, 46 for respectively guiding cam projections 12 and 13 are formed respectively in opposed walls 32, 42 of a frame-like body 31, 41. Fitting guide portions 37, 47 for respectively receiving the cam projections are formed respectively in extension walls 33, 43 extending respectively form the opposed walls. A window 35, 45 is formed in a guide groove 34, 44 formed in the extension wall, and is connected to an outlet of the cam groove. The extension walls of the first cam member are received respectively in the guide grooves in the second cam member, and the extension walls of the second cam member are received respectively in the guide grooves in the first cam member. The cam groove in the first cam member and the fitting guide portion in the second cam member are slanting in the same direction at the same angle, and the fitting guide portion in the first cam member and the cam groove in the second cam member are slanting in the same direction at the same angle. Therefore, a pair of connector housings can be fitted together with a lower insertion force.

14 Claims, 12 Drawing Sheets

LOW INSERTION FORCE CONNECTOR

BACKGROUND OF THE INVENTION

This invention relates to a low insertion force connector in which a pair of connectors are fitted together with a low insertion force by cam members.

Conventionally, a large insertion force has been required for fitting multi-pole connectors, having many terminals, together.

Therefore, it has been proposed to use a cam member for fitting a pair of connectors together with a low insertion force.

For fitting the pair of connectors together by the use of the cam member, the cam member is drawn out into a predetermined position, and then is pushed in so as to fit the pair of connectors together. However, this process is not entirely effective since before pushing them the step of drawing out the cam member is needed.

Therefore, as shown in FIG. 1, there has been proposed a connector assembly (disclosed in Japanese Patent Unexamined Publication No. 61-203581) in which a cam member, beforehand drawn out, is pushed in, and then a pair of connectors are fitted together.

More specifically, in FIG. 1, this connector assembly 80 comprises a first housing 81, a second housing 82, and a cam member 83. The cam member 83 is mounted on the first housing 81, and in this condition, when the second housing 82 is fitted into the first housing 81 as shown in FIG. 2(*a*), cam followers 84 on the second housing 82 are moved in slots 85 in the first housing 81 and respective cam slots 86 in the cam member 83, as shown in FIG. 2(*b*). As a result, the first housing 81 and the second housing 82 are fitted together.

However, during the time when the first housing 81, having the cam member 83 attached thereto, and the second housing 82 are transported independently of each other, there is a possibility that the cam member 83, attached to the first housing 81, is damaged.

Therefore, in order to prevent damage to the cam member 83, there has been proposed a connector with a cam member, which is disclosed in Japanese Utility Model Unexamined Publication No. 6-54255.

More specifically, in FIG. 3, this connector 90 comprises a female connector 91, a male connector 92, and the cam member 93. The cam member 93 is attached to the female connector 91 having male terminals a retained therein, and in this condition, the male connector 92, having female terminals b mounted therein, is fitted into the female connector 91. As a result, cam followers 94 on the male connector 92 are fitted respectively into cam grooves 95 in the cam member 93, as shown in FIG. 4(*a*). As the cam followers 94 are forced into the respective cam grooves 95, the cam member 93 is moved in a direction p. Then, when the cam member 93 is pushed in a direction g as shown in FIG. 4(*b*), the female connector 91 and the male connector 92 are fitted together with a low insertion force, as shown in FIG. 4(*c*).

However, the cam member 93 is pushed into the female connector 91 only in one direction, and therefore there has been encountered a problem that the operation of pushing the cam member 93 into the female connector 91 is troublesome depending on the position of mounting of the female connector 91, for example, on an automobile.

SUMMARY OF THE INVENTION

With the above problems in view, it is an object of this invention to provide a low insertion force connector in which when fitting a pair of connectors together by the use of a cam member, the operation of pushing the cam member is easy, and besides an insertion force, required for the pushing operation, is further reduced.

The above object has been achieved by a low insertion force connector of the invention comprising one connector housing having a pair of cam projections formed thereon; the other connector housing having a hood portion for receiving the one connector housing; fitting members which have cam grooves for guiding the cam projections, respectively, and are slidably received within the hood portion; wherein the fitting members are inserted through insertion holes formed in the hood portion, and the one and other connector housings are fitted together through engagement of the cam projections in the respective cam grooves; wherein the fitting members are constituted respectively by a first cam member and a second cam member; and the first cam member and the second cam member are inserted in the hood portion in opposed relation to each other.

The cam groove for guiding one of the cam projections is formed in an inner surface of each of opposed walls of a U-shaped, frame-like body of the first cam member, and is slanting in a direction of insertion of the first cam member; extension walls are formed respectively at free ends of the opposed walls in stepped relation thereto, and extend in the direction of insertion of the first cam member, the extension walls being smaller in thickness than the opposed walls; a fitting guide portion for receiving the other cam projection is formed in the extension wall, and is slanting in a direction opposite to the direction of slanting of the cam groove; a guide groove is formed in one of the inner and outer surfaces of each of the opposed walls in such a manner that a bottom surface of the guide groove and one of inner and outer surfaces of the extension wall are disposed in a common plane; and a window is formed in the bottom surface of the guide groove, and is connected to an outlet of the cam groove.

The cam groove for guiding the other cam projection is formed in an inner surface of each of opposed walls of a U-shaped, frame-like body of the second cam member, and is slanting in a direction of insertion of the second cam member; extension walls are formed respectively at free ends of the opposed walls of the second cam member in stepped relation thereto, and extend in the direction of insertion of the second cam member, the extension walls being smaller in thickness than the opposed walls; a fitting guide portion for receiving the one cam projection is formed in the extension wall, and is slanting in a direction opposite to the direction of slanting of the cam groove; a guide groove is formed in one of the inner and outer surfaces of each of the opposed walls in such a manner that a bottom surface of the guide groove and one of inner and outer surfaces of the extension wall are disposed in a common plane; a window is formed in the bottom surface of the guide groove, and is connected to an outlet of the cam groove; and when fitting the one and other connector housings together, the extension walls of the first cam member are received respectively in the guide grooves in the second cam member while the extension walls of the second cam members are received respectively in the guide grooves in the first cam member.

An angle of inclination of the cam groove in the first cam member is equal to an angle of inclination of the fitting guide portion in the second cam member, and the fitting guide portion in the first cam member and the cam groove in the second cam member are slanting at the same angle in the same direction.

The first cam member includes a base plate of a rectangular shape, a first guide plate formed on that portion of one edge of the base plate disposed close to the one connector housing, and a first retaining plate formed on that portion of the other edge of the base plate disposed close to the other connector housing, the first guide plate and the first retaining plate extending in the direction of insertion of the first cam member; the first cam groove for guiding the cam projection is formed in an inner surface of the first guide plate facing the first retaining plate, and is slanting in the inserting direction; and the first fitting guide portion for receiving the cam projection is formed in an inner surface of the first retaining plate facing the first guide plate, and is slanting in a direction opposite to the direction of slanting of the first cam groove.

The second cam member is identical in construction to the first cam member; the second cam member includes a second guide plate, a second retaining plate, the second cam groove and the second fitting guide portion corresponding respectively to the first guide plate, the first retaining plate, the first cam groove and the first fitting guide portion; and when the first cam member and the second cam member are inserted into the hood portion, side edges of the first guide plate and the second retaining plate slide relative to each other while side edges of the first retaining plate and the second guide plates slide relative to each other.

In a first aspect of the present invention, the fitting members are constituted respectively by the two members, that is, the first cam member and the second cam member, and the first cam member and the second cam member are inserted into the hood portion in the opposite directions, respectively, and therefore are opposed to each other within the hood portion.

In a second aspect of the present invention, the first cam member includes the cam grooves formed respectively in the opposed walls, and the fitting guide portions formed respectively in the extension walls, and the cam groove and the fitting guide portion are slanting in the opposite directions, respectively. The cam groove guides the one cam projection while the fitting guide portion receives the other cam projection.

In a third aspect of the present invention, the second cam member includes the cam grooves formed respectively in the opposed walls, and the fitting guide portions formed respectively in the extension walls, and the cam groove and the fitting guide portion are slanting in the opposite directions, respectively. The cam groove guides the other cam projection while the fitting guide portion receives the one cam projection. When the one and other connector housings are fitted together, the extension walls of the one connector housing are received respectively in the guide grooves in the other connector housing while the extension walls of the other connector housing are received respectively in the guide grooves in the one connector housing, and therefore the extension walls of the one connector housing will not intersect the extension walls of the other connector housing.

In a fourth aspect of the present invention, the cam groove in the first cam member and the fitting guide portion in the second cam member are slanting at the same angle in the same direction, and therefore during the insertion of the first and second cam members into the hood portion, the cam groove and the fitting guide portion are disposed on a straight line. Therefore, the one cam projection, guided by the cam groove in the first cam member, can be easily shifted into the fitting guide portion in the second cam member.

Also, the cam groove in the second cam member and the fitting guide portion in the first cam member are slanting at the same angle in the same direction, and therefore during the insertion of the first and second cam members into the hood portion, the cam groove and the fitting guide portion are disposed on a straight line. Therefore, the other cam projection, guided by the cam groove in the second cam member, can be easily shifted into the fitting guide portion in the first cam member.

In a fifth aspect of the present invention, the first guide plate of the first cam member is formed at that portion of one edge of the base plate disposed close to the one connector housing, and extends in the inserting direction, and the first retaining plate is formed on that portion of the other edge of the base plate disposed close to the other connector housing, and extends in the inserting direction. The first guide plate has the first cam groove and the first retaining plate has the first fitting guide portion, and thus both of the first cam groove and the first fitting guide portion are not provided in the first guide plate or the first retaining plate.

In a sixth aspect of the present invention, the second cam member includes the second guide plate, the second retaining plate, the second cam groove and the second fitting guide portion corresponding respectively to the first guide plate, the first retaining plate, the first cam groove and the first fitting guide portion, and the first cam member is identical in construction to the second cam member. Therefore, when the first and second cam members are inserted into the hood portion, the side edges of the first guide plate and the second retaining plate slide relative to each other while the side edges of the first retaining plate and the second guide plate slide relative to each other.

DETAILED DESCRIPTION OF THE PREFERRED EMBODIMENTS

Preferred embodiments of the invention will now be described with reference to the drawings.

FIGS. 5 to 9 show one preferred embodiment of a low insertion force connector of the invention. Those constituent members identical to those of the conventional construction will be represented by identical names, respectively, and detailed explanation thereof will be omitted.

Figure 1:
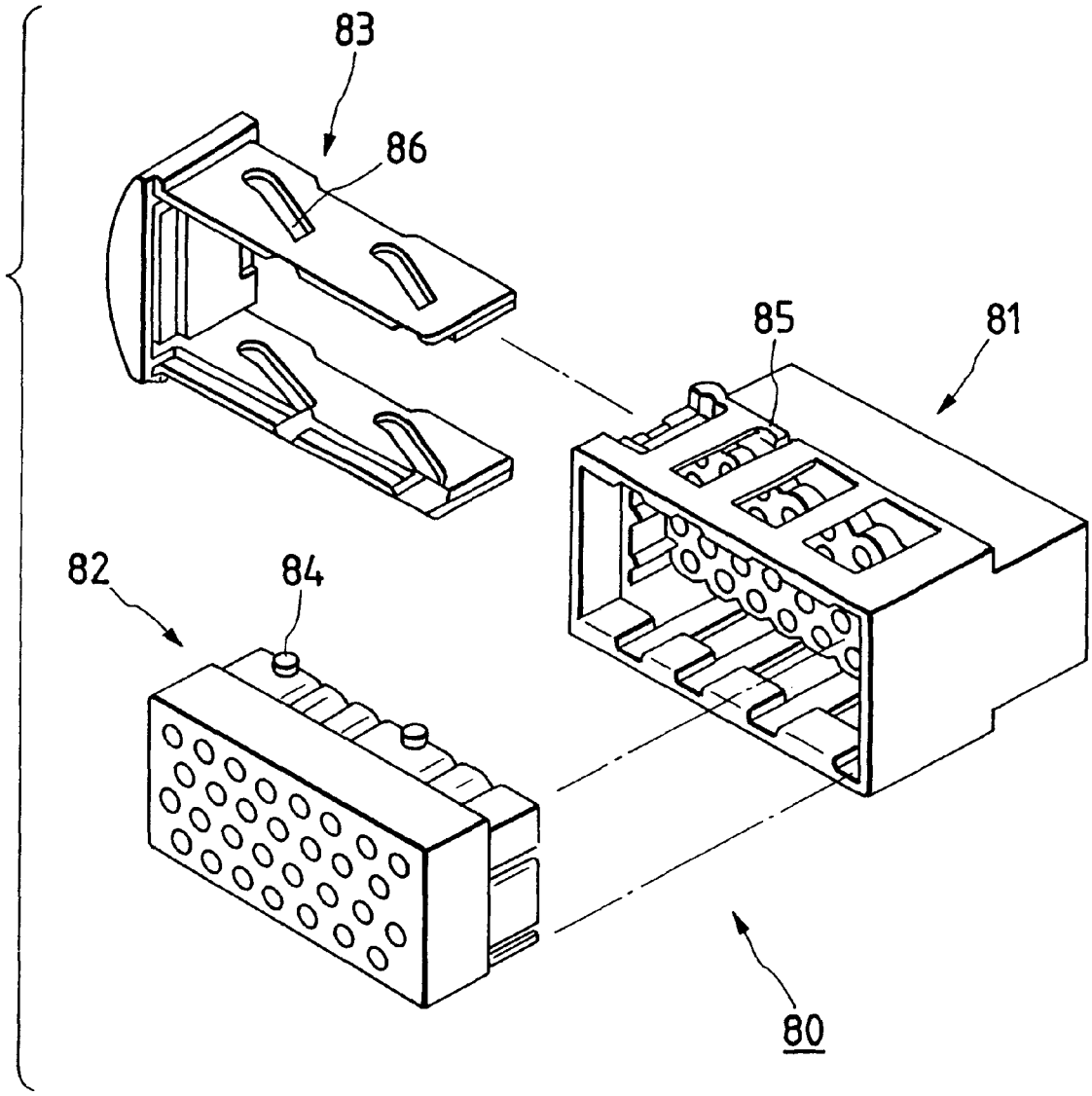
FIG. 1 PRIOR ART
FIG. 1 is a perspective view showing a conventional construction.
Figure 2A:
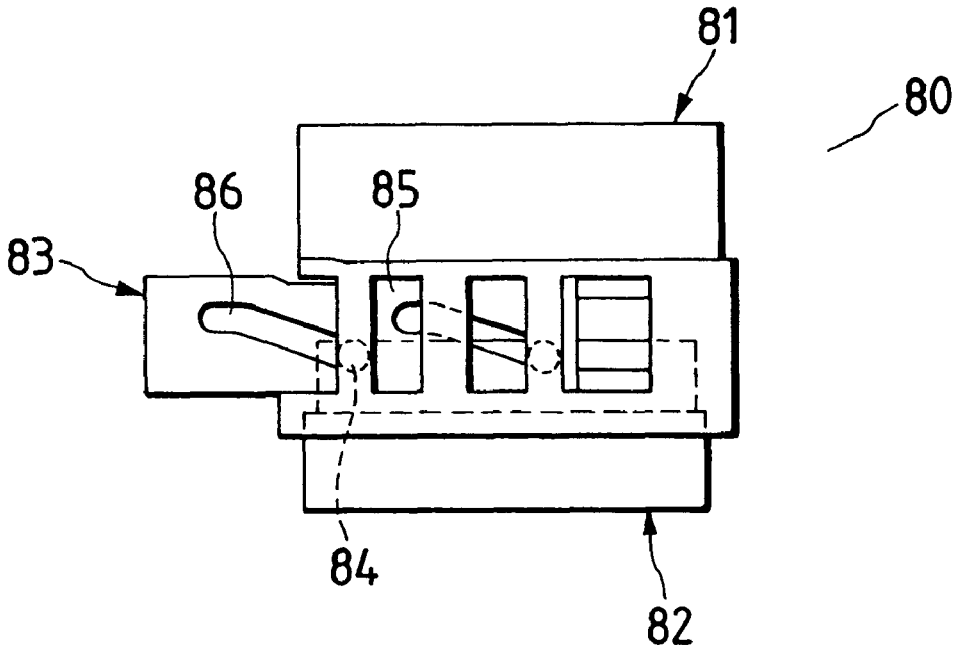
FIG. 2(a) PRIOR ART
FIGS. 2(*a*) and 2(*b*) are views explanatory of the fitting of a first housing relative to a second housing, FIG. 2(*a*) showing a condition before the fitting, and FIG. 2(*b*) showing a fitted condition.
Figure 2B:
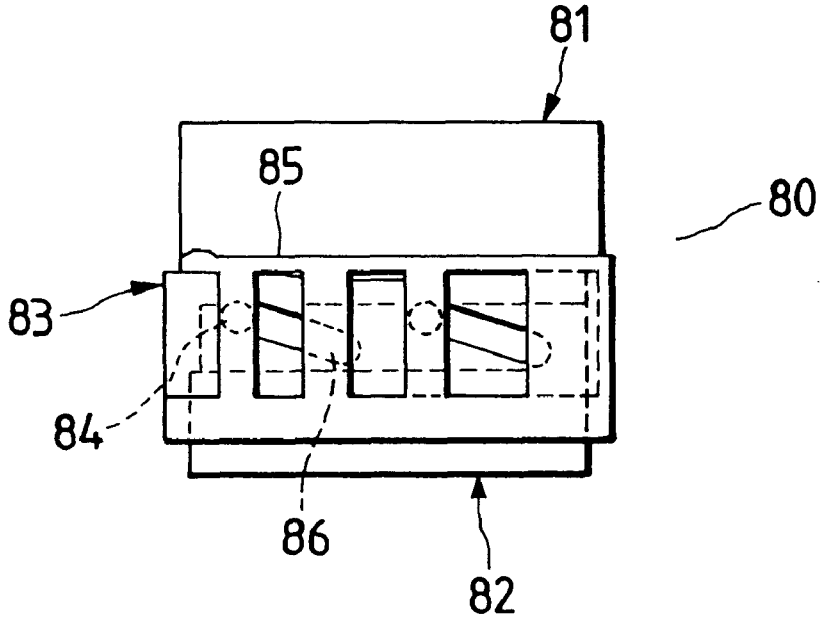
FIG. 2(b) PRIOR ART
Figure 3:
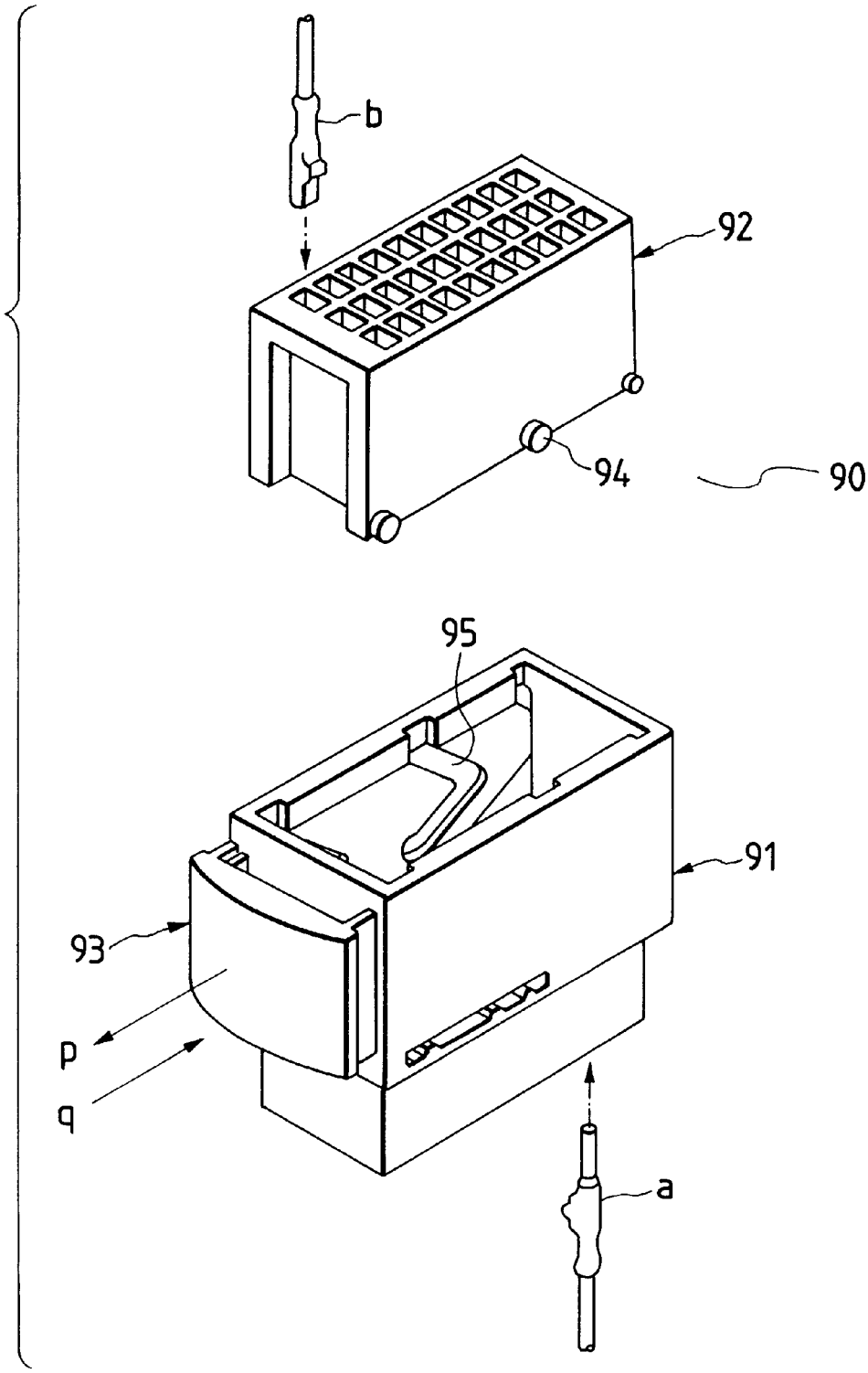
FIG. 3 PRIOR ART
FIG. 3 is a perspective view showing another conventional construction.
Figure 4A:
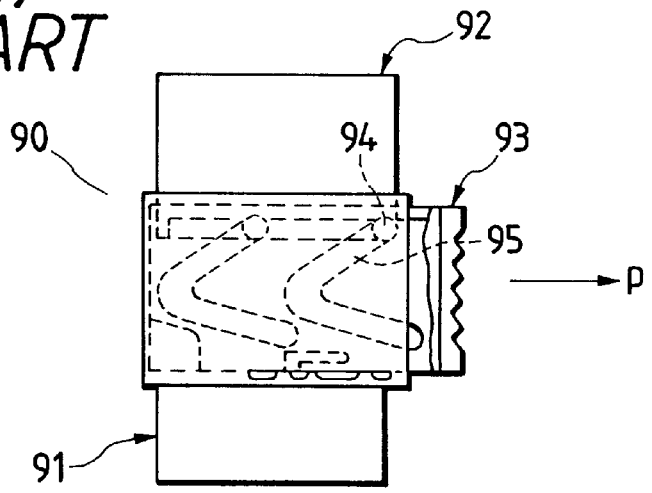
FIG. 4(a) PRIOR ART
FIGS. 4(*a*)–4(*c*) are views explanatory of the fitting of a male connector into a female connector, FIG. 4(*a*) showing a condition before the fitting, FIG. 4(*b*) showing a condition during the fitting, and FIG. 4(*c*) showing a fitted condition.
Figure 4B:
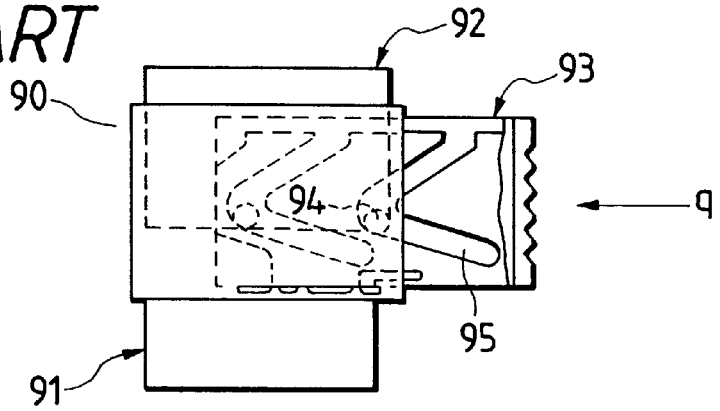
FIG. 4(b) PRIOR ART
Figure 4C:
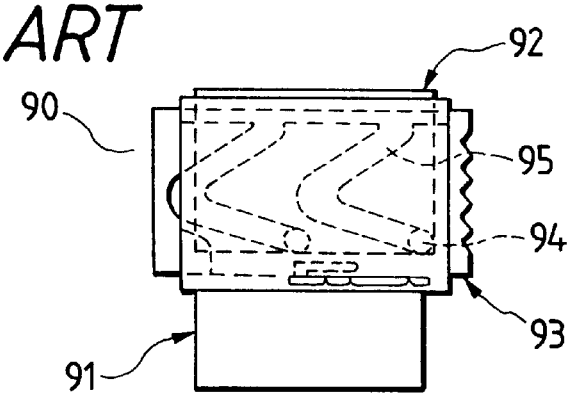
FIG. 4(c) PRIOR ART
Figure 5:
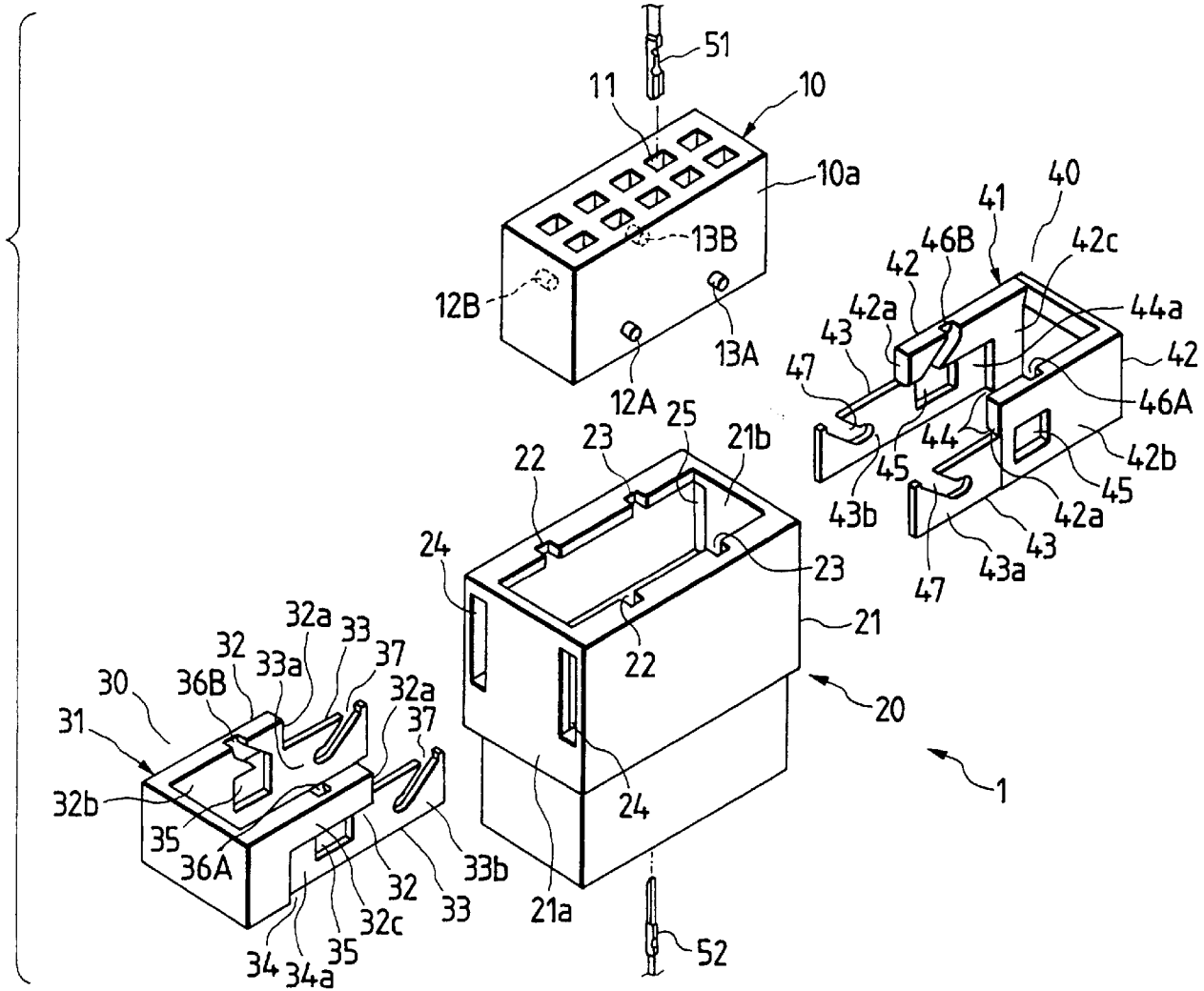
FIG. 5 is a perspective view showing a first embodiment of a low insertion force connector of the invention.

In FIG. 5, this low insertion force connector 1 comprises a pair of connector housings 10 and 20, and fitting members constituted respectively by a first cam member 30 and a second cam member 40.

Terminals 51 are received and retained respectively in terminal receiving chambers 11 in one connector housing 10, and a pair of cam projections 12A, 12B and 13A, 13B are formed on each of opposite longer side walls 10*a* of the connector housing 10, and are disposed close to that side thereof directed toward the other connector housing 20.

Terminals 52 are received and retained respectively in terminal receiving chambers (not shown) in the other connector housing 20, and a hood portion 21 for receiving the one connector housing 10 is formed in a bulged manner at a front end of the other connector housing 20. Introduction holes 22 and 23 for the two pairs of cam projections 12A, 12B and 13A, 13B are formed in a front end (directed toward the one connector housing 10) of the hood portion 21. Insertion holes 24 for inserting the first cam member 30 into the hood portion 21 are formed through a side wall 21*a* thereof intersecting a longitudinal axis of this hood portion, and insertion holes 25 for inserting the second cam member 40 into the hood portion 21 are formed through a side wall 21*b* thereof facing the side wall 21*a*.

Figure 6:
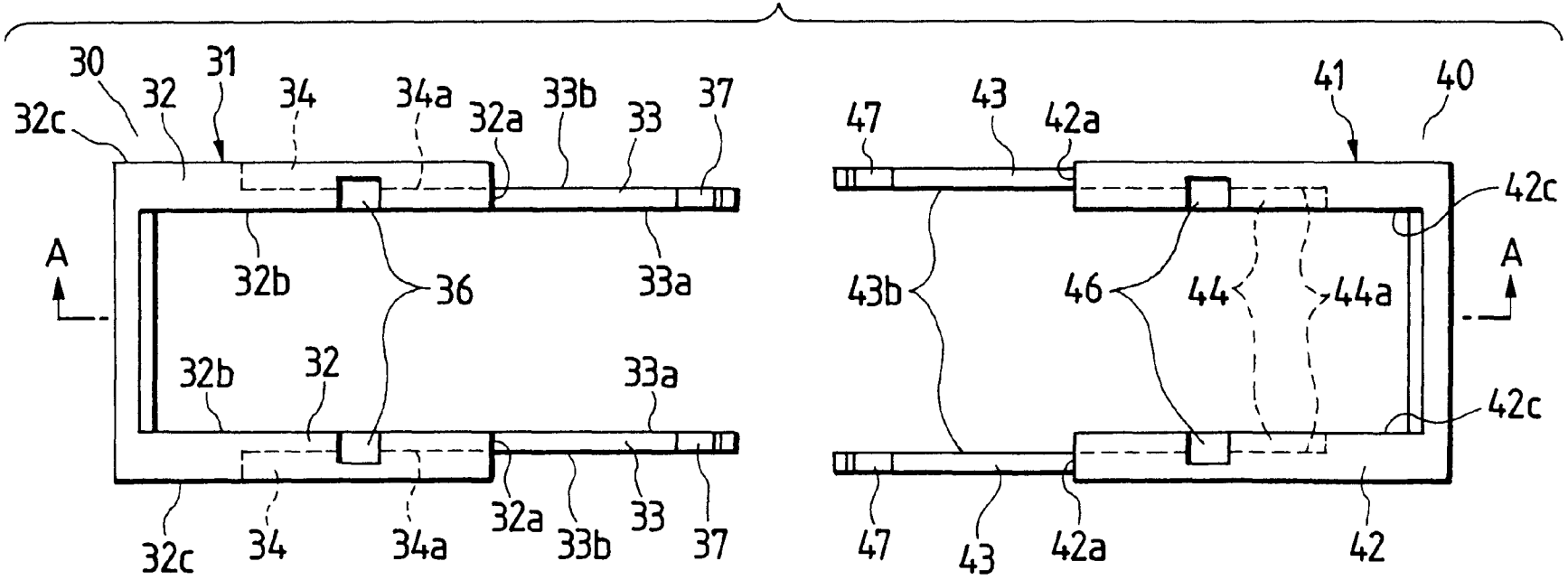
FIG. 6 is a plan view showing a first cam member and a second cam member in FIG. 5.
Figure 7:
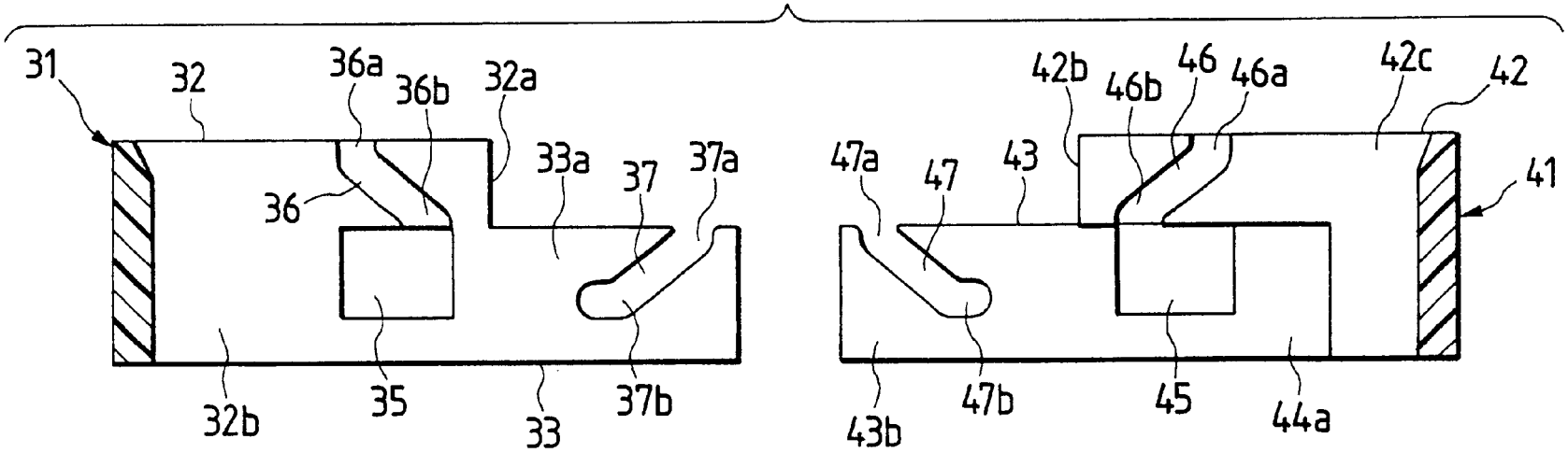
FIG. 7 is a cross-sectional view taken along the line A—A of FIG. 6.

As shown in FIGS. 5, 6 and 7, the first cam member 30 includes a frame-like body 31 of a U-shape, and extension walls 33 and 33 which extend respectively from free ends 32*a* and 32*a* of opposed walls 32 and 32 of the frame-like body 31 in a direction of insertion of the first cam member 30, and are stepped lower with respect to the opposed walls 32 and 32. The extension walls 33 are smaller in thickness than the opposed walls 32, and are arranged in such a manner that inner surfaces 33*a* of the extension walls 33 and inner surfaces 32*b* of the opposed surfaces 32 are disposed in respective common planes. That is, the inner surfaces 33*a* of the extension walls 33 are formed to be flush with the inner surfaces 32*b* of the opposed surfaces 32, respectively. A guide groove 34 is formed in an outer surface 32*c* of each of the opposed walls 32, and a bottom surface 34*a* of each guide groove 34 and an outer surface 33*b* of the associated extension wall 33 are disposed in a common plane.

A cam groove 36A, 36B for guiding the associated cam projection 12A, 12B is formed in the inner surface 32*b* of each of the opposed walls 32, and is slanting in the direction of insertion of the first cam member 30. At an outlet 36*b* of the cam groove 36, a rectangular window 35 is formed in the bottom surface 34*a* of the guide groove 34. A fitting guide portion 37 for guiding the associated cam projection 13 is formed through each of the extension walls 33, and is slanting in a direction opposite to the direction of slanting of the cam groove 36 (that is, in a direction opposite to the direction of insertion of the first cam member 30).

Preferably, an inlet portion 36*a* and the outlet portion 36*b* of the cam groove 36 extend in a vertical direction so that the cam projection 12 can smoothly come into and out of the cam groove 36. Preferably, an inlet portion 37*a* of the fitting guide portion 37 extends in a vertical direction so that the cam projection 13 can smoothly come into the fitting guide portion 37. Preferably, an extremity end portion 37*b* of the fitting guide portion 37 extends horizontally a small distance in a direction opposite to the direction of insertion of the first cam member 30 so that the cam projection 13 can be positively retained in the extremity end portion 37*b* of the fitting guide portion 37.

As shown in FIGS. 5, 6 and 7, the second cam member 40 is generally identical in construction to the first cam member 30, and includes a frame-like body 41 of a U-shape, and extension walls 43 and 43 extending respectively from distal ends 42*a* and 42*a* of opposed walls 42 and 42 of the frame-like body 41. The extension walls 43 are smaller in thickness than the opposed walls 42, and the extension walls 43 are arranged in such a manner that outer surfaces 43*a* of the extension walls 43 are disposed slightly outwardly of outer surfaces 42*b* of the opposed walls 42, respectively, and a bottom surface 44*a* of a guide groove 44, formed in an inner surface 42*c* of each of the opposed walls 42, and an inner surface 43*b* of the associated extension wall 43 are disposed in a common plane.

A cam groove 46A, 46B for guiding the associated cam projection 13 is formed in the inner surface 42*c* of each of the opposed walls 42*c*, and is slanting in a direction of insertion of the second cam member 40. At an outlet 46*b* of the cam groove 46A, 46B, a rectangular window 45 is formed in the bottom surface 44*a* of the guide groove 44. A fitting guide portion 47A, 47B for guiding the associated cam projection 12 is formed through each of the extension walls 43, and is slanting in a direction opposite to the direction of slanting of the cam groove 46A, 46B (that is, in a direction opposite to the direction of insertion of the second cam member 40).

Preferably, an inlet portion 46*a* and the outlet portion 46*b* of the cam groove 46 extend in a vertical direction, and an inlet portion 47*a* of the fitting guide portion 47 extends in a vertical direction, and an extremity end portion 47*b* of the fitting guide portion 47 extends horizontally a small distance in a direction opposite to the direction of insertion of the second cam member 40.

Figure 8A:
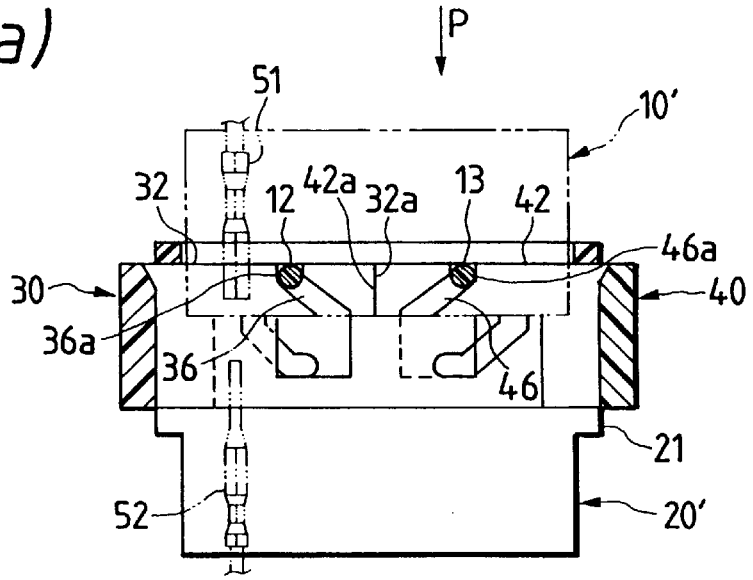
FIGS. 8(*a*)–8(*c*) are views showing a process of fitting one connector relative to the other connector, FIG. 8(*a*) showing a condition before the fitting, FIG. 8(*b*) showing a condition during the fitting, and FIG. 8(*c*) showing a fitted condition.
Figure 8B:
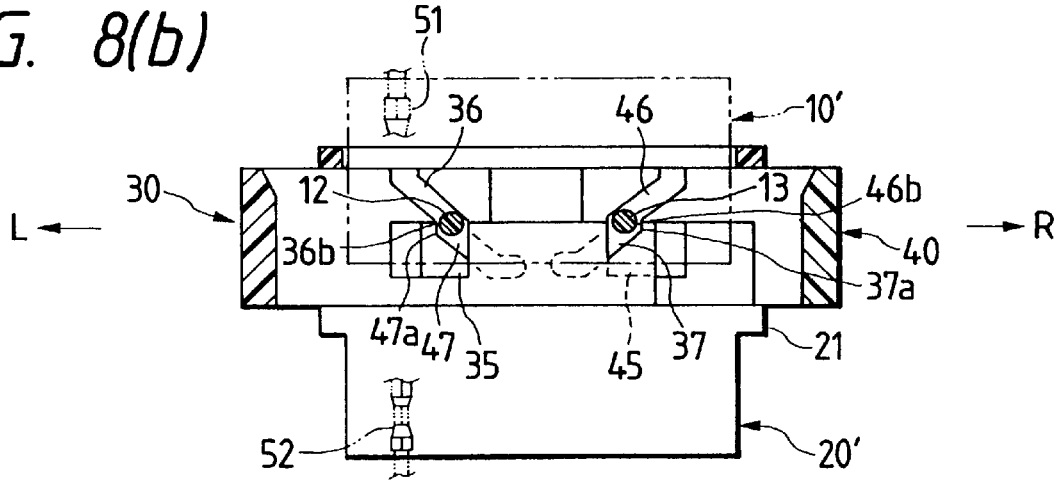
Figure 8C:
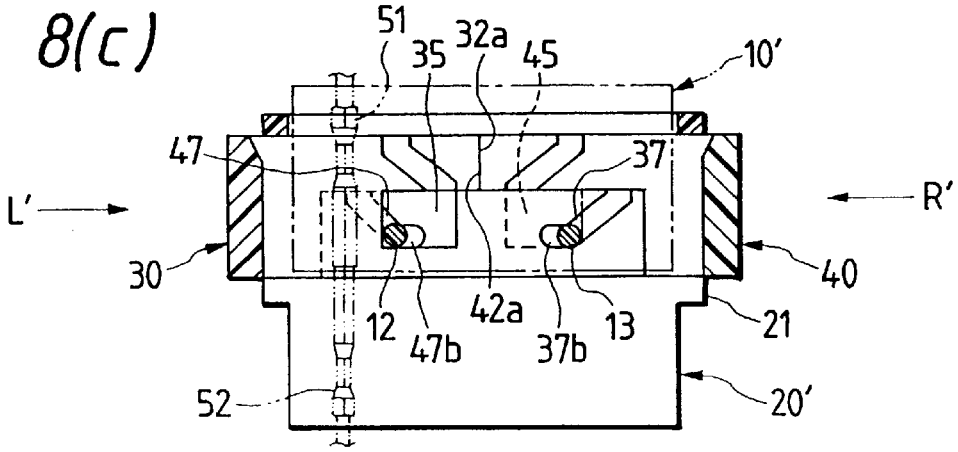
Figure 9:
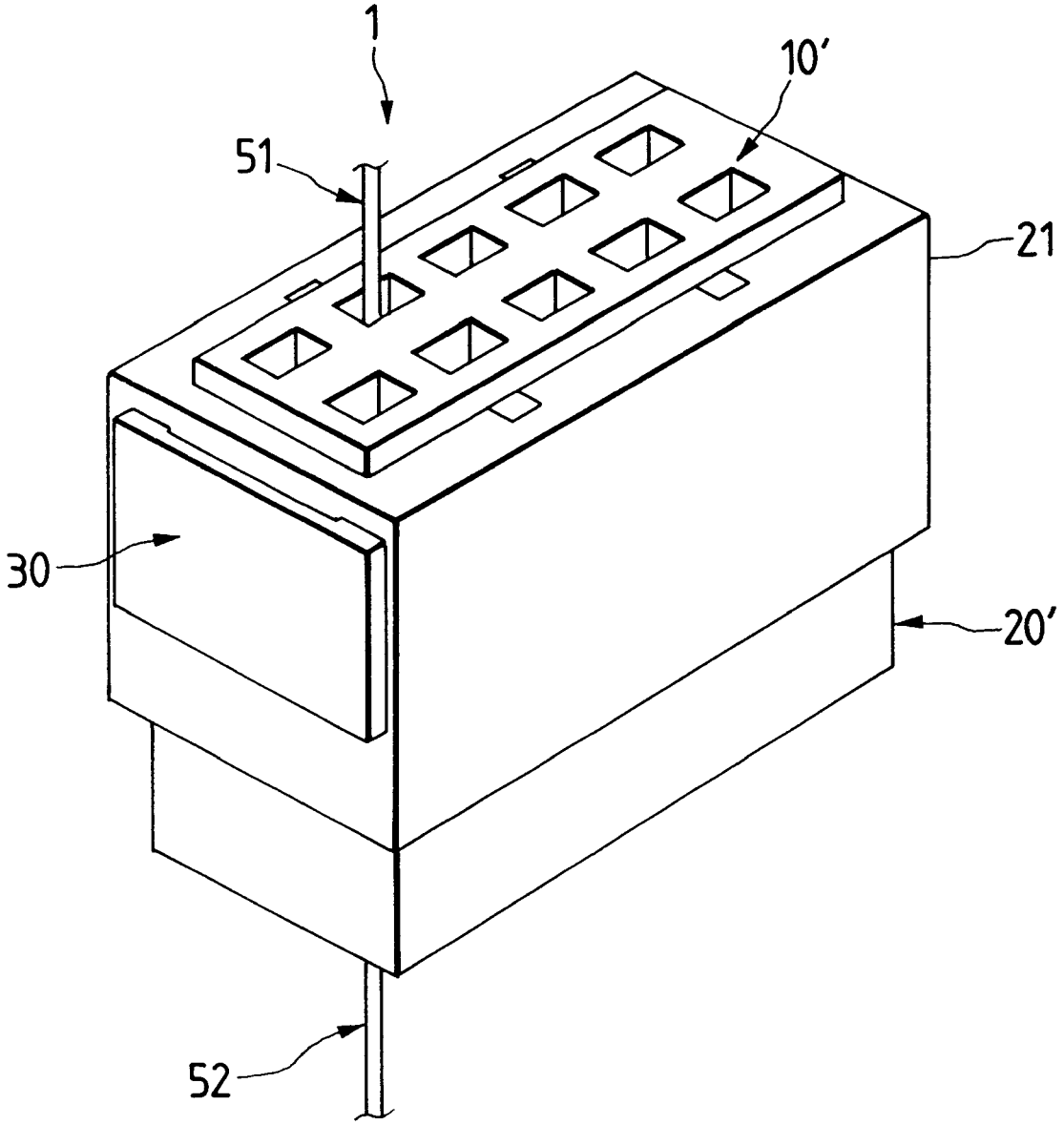
FIG. 9 is a perspective view showing the one and other connector housings in their fitted condition.

Next, description will be made of the manner of fitting the pair of connectors 10' and 20' (respectively comprising the pair of connectors housings 10 and 20 having their respective terminals 51 and 52 mounted therein) together by the first and second cam members 30 and 40 as shown in FIG. 8.

First, the first cam member 30 is inserted through the insertion holes 24 in the hood portion 21 whereas the second cam member 40 is inserted through the insertion holes 25 in the hood portion 21, as shown in FIG. 8(*a*). In the hood portion 21, the extension walls 43 are guided respectively to the guide grooves 34, and the extension walls 33 are guided respectively to the guide grooves 44, and the free ends 32*a* of the opposed walls 32 are held in contact with the free ends 42*a* of the opposed walls 42, respectively. In this condition, as the connector 10' is inserted into the hood portion 21, the cam projections 12 are introduced respectively into the inlet portions 36*a* of the cam grooves 36, and also the cam projections 13 are introduced respectively into the inlet portions 46*a* of the cam grooves 46.

Then, when the connector 10' is pushed in a direction P, the cam projections 12 advance respectively toward the outlet portions 36*b* of the cam grooves 36, and also the cam projections 13 advance respectively toward the outlet portions 46*b* of the cam grooves 46, as shown in FIG. 8(*b*). At the same time, the first cam member 30 is moved in a direction L, and also the second cam member 40 is moved in a direction R. When the first and second cam members 30 and 40 are stopped, each cam projection 12 reaches the inlet portion 47*a* of the associated cam groove 47 while each cam projection 13 reaches the inlet portion 37*a* of the associated cam groove 37. At this time, the terminals 51 in the connector 10' will not be brought into contact respectively with the terminals 52 in the connector 20', and therefore the first and second cam members 30 and 40 can be easily moved.

Finally, when the cam member 30 is pushed in a direction L' while the cam member 40 is pushed in a direction R' (see FIG. 8(*c*)), each cam projection 12 is moved toward the extremity end of the associated fitting guide portion 47 while each cam projection 13 is moved toward the extremity end of the associated fitting guide portion 37, and the terminals 51 begin to be electrically contacted with the terminals 52, respectively. Simultaneously when the free ends 32*a* of the first cam member 30 are abutted respectively against the free ends 42*a* of the second cam member 40, each cam projection 12 is retained by the extremity end portion 47*b* of the associated fitting guide portion 47 while each cam projection 13 is retained by the extremity end portion 37*b* of the associated fitting guide portion 37. At the same time, the terminals 51 are electrically contacted with the terminal 52, respectively, and the two connectors 10' and 20' are fitted together (see FIG. 9).

FIGS. 10 to 14 show a second embodiment of a low insertion force connector of the invention. Those constituent members identical to those of the first embodiment will be represented by identical names, respectively, and detailed explanation thereof will be omitted.

Figure 10:
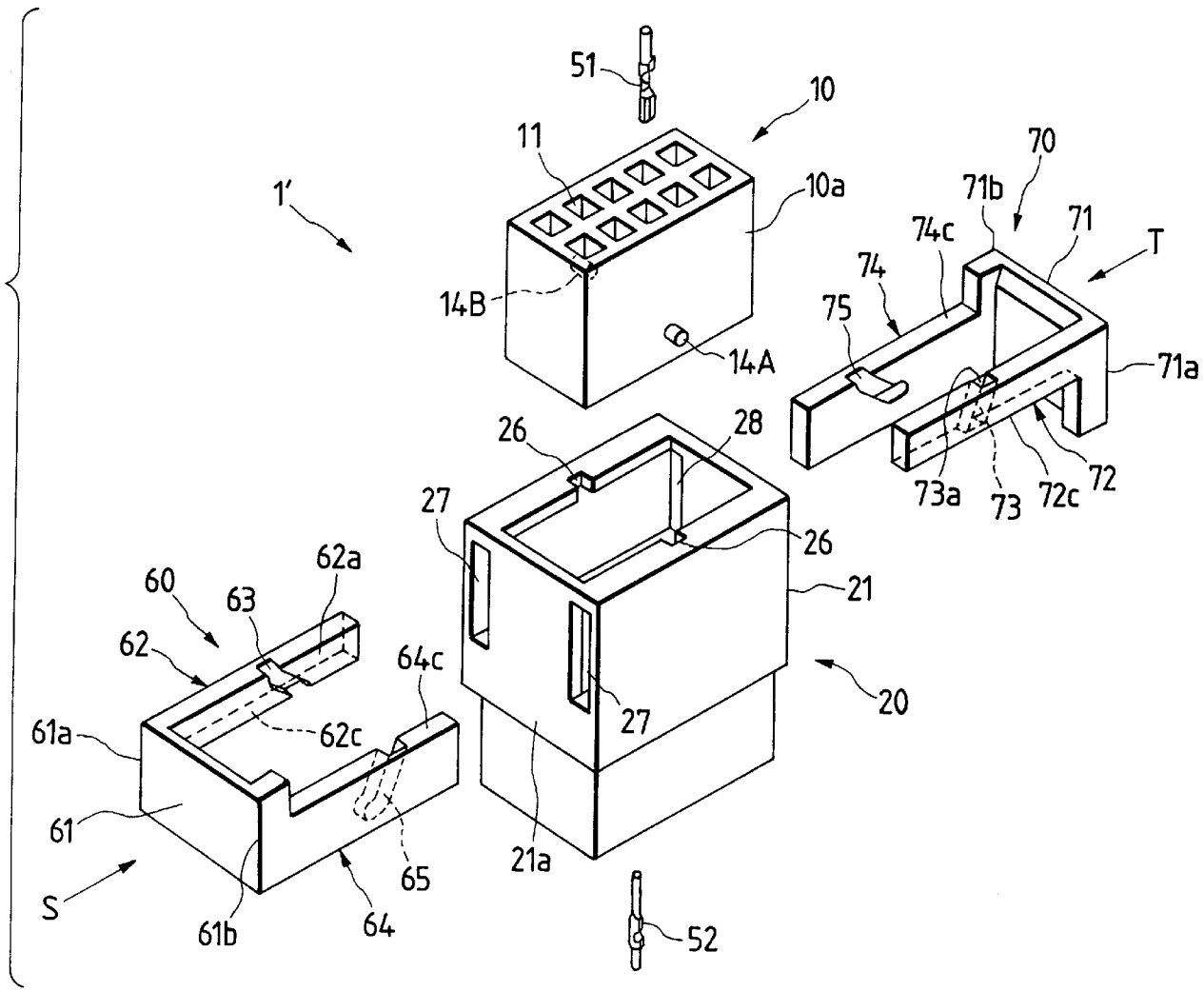
FIG. 10 is a perspective view showing a second embodiment of a low insertion force connector of the invention.
Figure 11:
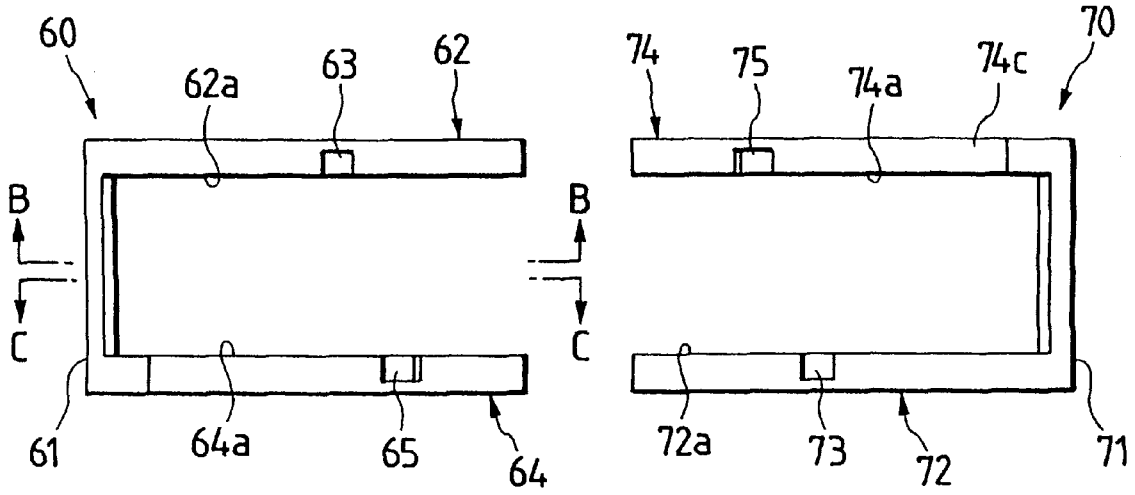
FIG. 11 is a plan view showing a first cam member and a second cam member in FIG. 10.
Figure 12:
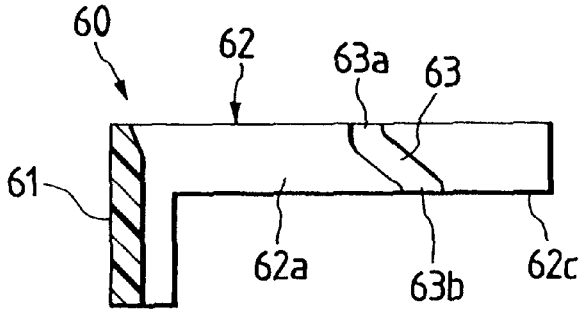
FIG. 12 is a cross-sectional view taken along the line B—B of FIG. 11.
Figure 13:
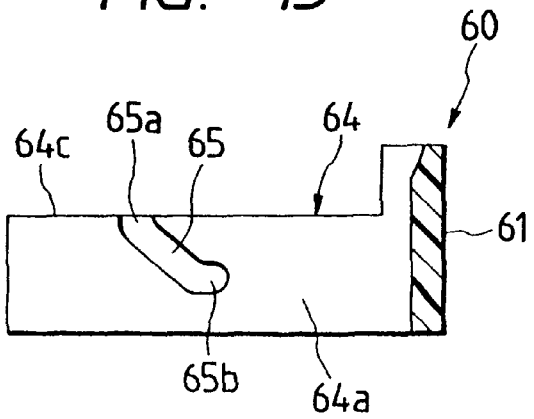
FIG. 13 is a cross-sectional view taken along the line C—C of FIG. 11.

In FIG. 10, this low insertion force connector 1' comprises a pair of connector housings 10 and 20, a first cam member 60, and a second cam member 70. Cam projections 14A, 14B are formed respectively on opposite side walls 10*a* of the connector housing 10, and are disposed close to that side thereof directed toward the other connector housing 20.

Introduction holes 26 for the cam projections 14 are formed in a front end of a hood portion 21 of the connector housing 20. Insertion holes 27 for inserting the first cam member 60 are formed through one side wall 21*a* of the hood portion 21 while insertion holes 28 for inserting the second cam member 70 are formed through another side wall 21*a* of the hood portion 21 opposed to the first-mentioned side wall 21*a*.

As shown in FIGS. 10 to 13, the first cam member 60 includes a base plate 61 of a rectangular shape, a first guide plate 62 of a flat configuration formed on one end or edge 61*a* of the base plate 61 at an upper portion thereof close to the connector housing 10, and a first retaining plate 64 of a flat configuration formed on the other end or edge 61*b* of the base plate 61 at a lower portion thereof close to the connector housing 20. A first cam groove 63 is formed in the first guide plate 62, and a first fitting guide portion 65 is formed in the first retaining plate 64.

The first guide plate 62 and the first retaining plate 64 extend in a direction (direction S) of insertion of the first cam member 60 into the hood portion 21, and are disposed parallel to each other.

The first guide plate 62 is provided at the upper portion of the one edge 61*a* of the base plate 61 which is about ⅓ of the length of this edge 61*a*, and the first retaining plate 64 is provided at the lower portion of the other edge 61*b* of the base plate 61 which is about ⅔ of the length of this edge 61*b*.

The first cam groove 63 is formed in an inner surface 62*a* of the first guide plate 62, and is slanting in the direction S. The first cam groove 63 has an inlet portion 63*a* and an outlet portion 63*b* for the cam projection 14B. The first fitting guide portion 65 is formed in an inner surface 64*a* of the first retaining plate 64, and is slanting in a direction opposite to the direction of slanting of the first cam groove 63. The first fitting guide portion 65 has an inlet portion 65*a* for the cam projection 14A, and an extremity end portion 65*b* for retaining the cam projection 14A.

Thus, the first cam groove 63 is formed in the first guide plate 62, and the first fitting guide portion 65 is formed in the first retaining plate 64, and therefore even if the configuration of the first cam groove 63 and the angle of inclination thereof are changed, such change will not influence the configuration and inclination angle of the first fitting guide portion 65. Namely, the first cam groove 63 and the first fitting guide portion 65 can be designed independently of each other.

The second cam member 70 is identical in construction to the first cam member 60. More specifically, a second guide plate 72 is formed on one edge 71*a* of a base plate 71 of the second cam member 70, and a second retaining plate 74 is formed on the other edge 71*b* of the base plate 71. A second cam groove 73 is formed in the second guide plate 72, and is slanting in a direction (direction T) of insertion of the second cam member 70, and a second fitting guide portion 75 is formed in the second retaining plate 74, and is slanting in a direction opposite to the direction of slanting of the second cam groove 73.

Thus, the first cam member 60 and the second cam member 70 have the same construction, and the two members 60 and 70 can be used in common with each other, and therefore the first and second cam members 60 and 70 can be formed by utilizing one mold (not shown). As a result, the cost, required for molding the first and second cam members 60 and 70, is reduced. In this embodiment, although one cam projection 14A OR 14B is formed on each of the opposite side walls of the connector housing 10, the first and second cam members 60 and 70 can be used even for the case where the pair of cam projections 12 and 13 are formed on each of the opposite side walls as in the first embodiment.

Next, description will be made of the manner of fitting the pair of connectors 10' and 20' together by the use of the first and second cam members 60. Although description will be made with respect to only one of the cam projections 14A on the connector housing 10, this is the same with the other cam projection 14B.

Figure 14A:
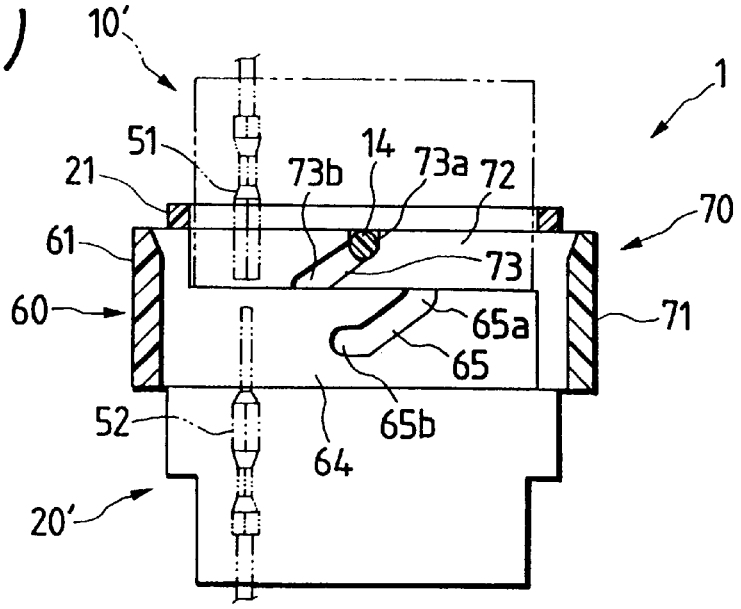
FIGS. 14(*a*)–14(*c*) are views showing a process of fitting one connector relative to the other connector, FIG. 14(*a*) showing a condition before the fitting, FIG. 14(*b*) showing a condition during the fitting, and FIG. 14(*c*) showing a fitted condition.
Figure 14B:
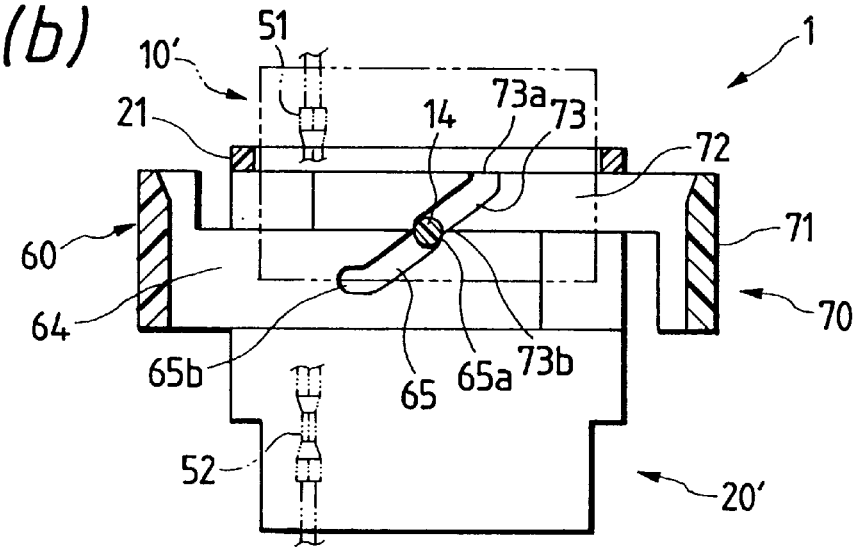
Figure 14C:
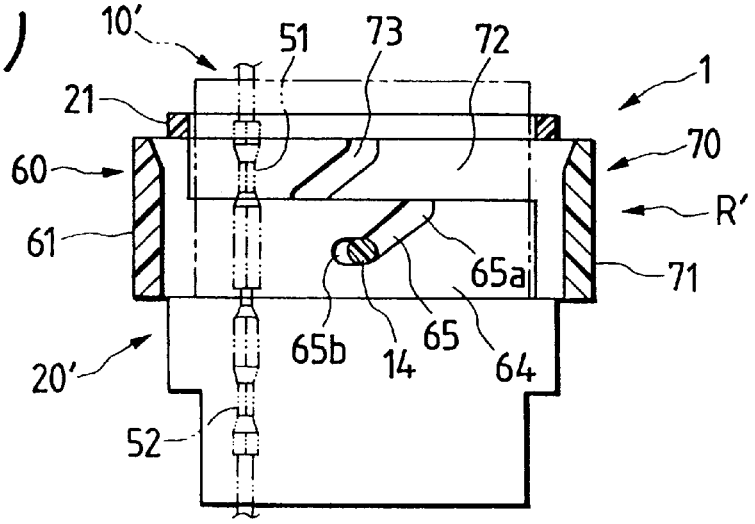

First, as shown in FIG. 14(*a*), terminals 51 are received and retained respectively in terminal receiving chambers 11 in the connector housing 10 to provide the connector 10', and terminals 52 are received and retained respectively in terminal receiving chambers (not shown) in the connector housing 20 to provide the connector 20'. The first cam member 60 and the second cam member 70, introduced into the hood portion 21 through the respective insertion holes 27 and 28, are completely inserted into the hood portion 21 through the sliding movement between side edges 62*c* and 74*c* of the first guide plate 62 and the second retaining plate 74 and through the sliding movement between side edges 72*c* and 64*c* of the second guide plate 72 and the first retaining plate 64.

Then, the cam projection 14A on the connector 10' is introduced into the hood portion 21 through the introduction hole 26, and is inserted into an inlet portion 73*a* of the second cam groove 73. In this condition, the first cam member 60 and the second cam member 70 are drawn out respectively in opposite directions through the respective insertion holes 27 and 28 as shown in FIG. 14(*b*), the cam projection 14A is drawn into the second cam groove 73. When the first cam member 60 and the second cam member 70 are fully drawn out, the cam projection 14A comes out of an outlet portion 73*b* of the second cam groove 73, and enters the inlet portion 65*a* of the first fitting guide portion 65, and the terminals 51 begin to be electrically contacted with the mating terminals 52, respectively.

Finally, when the first cam member 60 and the second cam member 70 are pushed into the hood portion 21 toward each other as shown in FIG. 14(*c*), the cam projection 14A slides along the first fitting guide portion 65. When the first and second cam members 60 and 70 are fully pushed into the hood portion, the cam projection 14A reaches the extremity end portion 65*b* of the first fitting guide portion 65, and is retained there. In this retained condition, the terminals 51 are electrically connected to the mating terminals 52, respectively, and also the two connectors 10' and 20' are completely fitted together.

For disconnecting the connector 10' from the connector 20', the first cam member 60 and the second cam member 70 are once drawn out to break the electrical connection of the terminals 51 from the mating terminals 52. Then, a first he first and second cam members 60 and 70 are fully drawn out, they are again pushed into the hood portion 21, thereby breaking the fitting between the two connectors 10' and 20'.

As described above, in the first to sixth aspect of the present invention, the first and second cam members (fitting members) are inserted into the hood portion respectively in the opposite directions, and therefore are opposed to each other within the hood portion. Therefore, the first and second members are simultaneously operated so that the two connectors housings can be fitted together and disconnected from each other with a insertion force lower than that required for the conventional construction.

The one cam projection is guided by the cam groove in the first cam member, and then is received in the fitting guide portion in the second cam member whereas the other cam projection is guided by the cam groove in the second cam member, and then is received in the fitting guide portion in the first cam member. Then, the extension walls of the first cam member are received respectively in the guide grooves in the second cam member whereas the extension walls of the second cam member are received respectively in the guide grooves in the first cam member, so that the first and second cam members will not intersect each other within the hood portion. Therefore, the first and second cam members do not need to be drawn out to respective predetermined positions, but are pushed in toward each other, so that the two connector housings can be easily fitted together.

The cam groove in the first cam member and the fitting guide portion in the second cam member (hereinafter referred to as "former") are slanting at the same angle in the same direction, and the cam groove in the second cam member and the fitting guide portion in the first cam member (hereinafter referred to as "latter") are slanting at the same angle in the same direction. Therefore, during the time when the two connector housings are fitted together, the former portions, as well as the latter portions, are disposed in a straight line, and therefore the one cam projection can be smoothly moved into the former while the other cam projection can be smoothly moved into the latter.

Therefore, the insertion force, required for fitting the one and other connector housings together, is reduced to a level lower than that required for the conventional construction. Therefore, for fitting the one connector housing into the other connector housing mounted in a narrow space in a vehicle, the one connector housing can be easily and positively fitted into the other connector housing, using one of the first and second cam members, and therefore the fitting of the one connector housing into the other connector housing can be effected rapidly and accurately.

In the fifth aspect of the present invention, both of the first cam groove and the first fitting guide portion of the first cam member are not formed in the first guide plate or the first retaining plate, and therefore the first cam groove, as well as the first fitting guide portion, can be easily changed in shape. Therefore, for example, a change of the shape of the first cam groove (or the first fitting guide portion) will not influence the first fitting guide portion (or the first cam groove) in contrast with the conventional construction. Therefore, the one connector housing and the other connector housing can be fitted together with a lower insertion force.

In the sixth aspect of the present invention, since the first cam member and the second cam member are identical in construction to each other, the two can be produced using one kind of mold. Therefore, the production cost can be further reduced.

While there has been described in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. A low insertion force connector comprising:

a first connector housing having a pair of cam projections respectively formed on opposite side walls thereof;

a second connector housing having a hood portion for receiving said first connector housing; and fitting members slidably inserted and received within said hood portion through insertion holes formed in said hood portion for fixedly coupling said first connector housing with said second connector housing, wherein said fitting members comprises a first cam member and a second cam member which are inserted in said hood portion in opposed relation to each other.

2. A low insertion force connector according to claim 1, in which said first cam member comprises a first cam groove for guiding one of said cam projections and second cam groove for guiding the other of said cam projections, and said second cam member comprises a first cam groove for guiding said other of said cam projections and a second cam groove for guiding said one of said cam projection.

3. A low insertion force connector according to claim 2, in which an angle of inclination of said first cam groove in said first cam member is equal to an angle of inclination of said second cam groove in said second cam member, and said second guide groove in said first cam member and said first cam groove in said second cam member are slanting at the same angle in the same direction.

4. A low insertion force connector according to claim 2, in which said second cam groove of said first cam member and said second cam groove of said second cam member are made in the form of a slit-shape.

5. A low insertion force connector according to claim 2, in which said first cam member is made of a U-shaped frame-like body constituted by a base plate and opposed walls, wherein said first cam groove of said first cam member is formed in an inner surface of one of said opposed walls, and is slanting in a direction of insertion of said first cam member;

said second cam groove of said first cam member is formed in an inner surface of the other of said opposed walls, and is slanting in a direction opposite to the direction of slanting of said first cam groove of said first cam member.

6. A low insertion force connector according to claim 5, in which said second cam member is made of a U-shaped frame-like body constituted by a base plate and opposed walls, wherein said first cam groove of said second cam member is formed in an inner surface of one of said opposed walls, and is slanting in a direction of insertion of said second cam member;

said second cam groove of said second cam member is formed in an inner surface of the other of said opposed walls, and is slanting in a direction opposite to the direction of slanting of said first cam groove of said second cam member.

7. A low insertion force connector according to claim 2, in which said first cam member is made of a U-shaped frame-like body constituted by a base plate and opposed walls, wherein said first cam groove of said first cam member is formed in an inner surface of at least one of said opposed walls, and is slanting in a direction of insertion of said first cam member;

extension walls of said first cam member are formed respectively at free ends of said opposed walls in stepped relation thereto, and extend in the direction of insertion of said first cam member, said extension walls being smaller in thickness than said opposed walls;

said second cam groove of said first cam member is formed in at least one of said extension wall, and is slanting in a direction opposite to the direction of slanting of said first cam groove of said first cam member;

a guiding recess of said first cam member is formed in one of the inner and outer surfaces of each of said opposed walls in such a manner that a bottom surface of said guiding recess and said one of inner and outer surfaces of said extension wall are disposed in a common plane.

8. A low insertion force connector according to claim 7, in which said second cam member is made of a U-shaped frame-like body constituted by a base plate and opposed walls, wherein said first cam groove of said second cam member is formed in an inner surface of at least one of said opposed walls, and is slanting in a direction of insertion of said second cam member;

extension walls of said second cam member are formed respectively at free ends of said opposed walls in stepped relation thereto, and extend in the direction of insertion of said second cam member, said extension walls being smaller in thickness than said opposed walls;

said second cam groove of said second cam member is formed in at least one of said extension wall, and is slanting in a direction opposite to the direction of slanting of said first cam groove of said second cam member; and a guiding recess of said second cam member is formed in one of the inner and outer surfaces of each of said opposed walls in such a manner that a bottom surface of said guiding recess and said one of inner and outer surfaces of said extension wall are disposed in a common plane.

9. A low insertion force connector according to claim 8, wherein when fitting said first and second connector housings together, said extension walls of said first cam member are received respectively in said guiding recesses of said second cam member while said extension walls of said second cam members are received respectively in said guiding recesses of said first cam member.

10. A low insertion force connector according to claim 8, wherein each of said first and second cam members comprises a window which is formed in the bottom surface of said guiding recess thereof and is connected to an outlet of said first cam groove thereof.

11. A low insertion force connector according to claim 10, wherein when fitting said first and second connector housings together, said extension walls of said first cam member are received respectively in said guiding recesses of said second cam member while said extension walls of said second cam members are received respectively in said guiding recesses of said first cam member.

12. A low insertion force connector according to any one of claims 1–4, in which said first cam member and said second cam member are identical in construction to each other.

13. A lower insertion force connector according to claim 2, in which said first cam member includes a base plate of a rectangular shape, a first guide plate formed on one edge of said base plate, and a first retaining plate formed on the other edge of said base plate, said first guide plate and said first retaining plate extending in the direction of insertion of said first cam member;

said first cam groove is formed in an inner surface of said first guide plate facing said first retaining plate, and is slanting in said inserting direction; and the second cam groove is formed in an inner surface of said first retaining plate facing said first guide plate, and is slanting in a direction opposite to the direction of slanting of said first cam groove.

14. A low insertion force connector according to claim 13, in which said second cam member is identical in construction to said first cam member;

said second cam member includes a second guide plate, a second retaining plate, said first cam groove and said second cam groove corresponding respectively to said first guide plate, said first retaining plate, said first cam groove and said second cam groove of said first cam member; and when said first cam member and said second cam member are inserted into said hood portion, side edges of said first guide plate and said second retaining plate slide relative to each other while side edges of said first retaining plate and said second guide plates slide relative to each other.

* * * * *